US009145675B2

(12) United States Patent
Gimpel et al.

(10) Patent No.: US 9,145,675 B2
(45) Date of Patent: Sep. 29, 2015

(54) TUNABLE ACOUSTIC PANEL

(71) Applicant: Wenger Corporation, Owatonna, MN (US)

(72) Inventors: Dixon Gimpel, Prior Lake, MN (US); Matthew Hildebrand, Lakeville, MN (US); Ronald Freiheit, Owatonna, MN (US); Aaron T. Harris, Owatonna, MN (US); Dennis Meyer, Owatonna, MN (US); Mark Gallea, Waseca, MN (US)

(73) Assignee: Wenger Corporation, Owatonna, MN (US)

( * ) Notice: Subject to any disclaimer, the term of this patent is extended or adjusted under 35 U.S.C. 154(b) by 0 days.

(21) Appl. No.: 14/290,437

(22) Filed: May 29, 2014

(65) Prior Publication Data

US 2014/0353079 A1 Dec. 4, 2014

Related U.S. Application Data

(60) Provisional application No. 61/828,261, filed on May 29, 2013.

(51) Int. Cl.
*E04B 1/99* (2006.01)
*E04B 1/86* (2006.01)

(52) U.S. Cl.
CPC .. *E04B 1/994* (2013.01); *E04B 1/86* (2013.01)

(58) Field of Classification Search
CPC ..... G10K 11/20; E04B 1/99; E04B 41/82
USPC ..... 181/30, 290, 284, 286
See application file for complete search history.

(56) References Cited

U.S. PATENT DOCUMENTS

| | | | | |
|---|---|---|---|---|
| 2,887,173 | A | 5/1959 | Boschi | |
| 2,994,401 | A | 8/1961 | Bourne et al. | |
| 3,049,190 | A | 8/1962 | Coffman | |
| 3,411,605 | A | 11/1968 | Coffman et al. | |
| 3,498,405 | A | 3/1970 | Charpentier | |
| 3,590,354 | A | 6/1971 | Shiflet | |
| 4,057,123 | A * | 11/1977 | Erickson | 181/286 |
| 4,226,299 | A | 10/1980 | Hansen | |
| 4,312,259 | A * | 1/1982 | Henrit | 84/411 A |
| 4,605,088 | A | 8/1986 | Sickels | |
| 4,682,670 | A | 7/1987 | Lerner et al. | |
| 4,821,839 | A | 4/1989 | D'Antonio et al. | |
| 5,035,298 | A | 7/1991 | Noxon | |
| 5,760,349 | A * | 6/1998 | Borchers et al. | 181/286 |
| 5,896,710 | A | 4/1999 | Hoyle | |
| 5,923,002 | A | 7/1999 | McGrath et al. | |
| 5,969,301 | A | 10/1999 | Cullum, Jr. et al. | |
| 6,209,680 | B1 | 4/2001 | Perdue | |
| 6,530,451 | B2 * | 3/2003 | Noselli | 181/179 |
| 6,782,971 | B2 | 8/2004 | Dutton et al. | |
| 7,178,630 | B1 | 2/2007 | Perdue | |
| 7,520,370 | B2 | 4/2009 | Gudim | |
| 7,565,951 | B1 * | 7/2009 | Perdue | 181/287 |
| 7,905,323 | B2 * | 3/2011 | Larsen | 181/287 |
| 8,006,802 | B2 | 8/2011 | Honji | |
| 8,136,630 | B2 | 3/2012 | Schnitta | |
| 8,616,330 | B1 * | 12/2013 | McKnight et al. | 181/207 |
| 2012/0103721 | A1 * | 5/2012 | Quasney et al. | 181/290 |

* cited by examiner

*Primary Examiner* — Forrest M Phillips
(74) *Attorney, Agent, or Firm* — Patterson Thuente Pedersen, P.A.

(57) ABSTRACT

A tunable acoustic panel that functions as an acoustic diffuser and absorber is disclosed. The acoustic properties of the tunable acoustic panel can be quickly and conveniently modified by moving a handle. The tunable acoustic panel is wall-mountable for use as an acoustical room treatment to selectively vary the acoustical response of a room or performance space.

20 Claims, 10 Drawing Sheets

TUNABLE ACOUSTIC PANEL

RELATED APPLICATIONS

This application claims the benefit of U.S. Provisional Application No. 61/828,261, filed May 29, 2013, which is hereby fully incorporated herein by reference.

FIELD OF THE INVENTION

The present invention relates to acoustical room treatments, and more specifically relates to a tunable acoustic panel that functions as an acoustic diffuser and absorber, the method for the production thereof, and a method of selectively varying the acoustical response of a room or performance space.

BACKGROUND OF THE INVENTION

For indoor rooms intended primarily for listening to music, whether residential rooms used for watching television or listening to recorded music, or public auditoriums or enclosures employed for listening to live music, it is desired that the quality of the heard sound be as accurate as the produced sound.

It is well known that rooms can produce distortional acoustic effects such as echoes, reverberations, amplified bass tones, and uneven volume distribution throughout the room. Systems for improving the sound quality of indoor rooms have been disclosed in U.S. Pat. Nos. 3,049,190; 3,411,605; 3,590,354; 4,226,299; 4,605,088; 4,682,670; 5,035,298; 5,896,710; 6,530,451; 6,782,971, all being incorporated herein by reference. Such prior systems generally employ large volume panels that attach to the walls or employ floor-standing structures, some of which are movable or adjustable nature. Such panels and related structures are usually of bulky, heavy and expensive construction, or difficult to install, or detract from the aesthetic appearance or floor space of the room. The prior art systems did not address the needs for performance areas such as college recital halls or school cafetoriums areas where variable acoustics are often required. Moreover, past systems have not adequately addressed the problem that the same room or performance space is often used for different purposes that present different acoustic challenges.

Present day music rooms are usually shared between different type of bands (jazz and concert), orchestras (wind ensembles and string ensembles), and choirs (vocal and jazz) with the acoustics being a compromise between these various uses. A homemade solution to this problem is an acoustic panel that folds out for absorption and folds in for diffusion. Retractable curtains are also commonly used, but very seldom work effectively. For the performing arts market, motorized banners are used to vary acoustics. One limitation of the prior art devices is that modifying the acoustic character of a room requires considerable time and manpower or are complex to operate.

It is accordingly an object of the present invention to provide a device that has a quick and simple modification of its acoustic diffusion and absorption properties. It is a further object of this invention to provide a method modifying of a room's acoustic character by using a tunable acoustic panel. It is also an object of this invention to provide a method of making a tunable acoustic device that can be tuned with a single mechanical movement. It is yet another object of this invention to provide a kit and instructions that optimizes the shipping of a tunable acoustic panel yet allows for simple assembly of its component parts.

SUMMARY OF THE INVENTION

The purpose of the present invention is to provide the ability to quickly and easily increase or decrease reverberation in a rehearsal or performance room. The tunable acoustic panel enables a rehearsal room to be satisfactorily used for both instrumental and choral rehearsal. Instrumental groups prefer a more absorbent environment (0.8 seconds of reverberation time) while choral groups prefer more reverberation (up to 1.5 seconds). Prior art devices do not provide this type of flexibility in an acoustical panel system.

The invention enables the changing of a room's acoustic characteristics between absorption to diffusion by one person, presents an aesthetically pleasing finish, provides a broad range of frequency absorption, is competitively priced with fixed acoustic panels, and is easy to install.

Embodiments of the present invention are directed to an acoustic panel with an internal mechanism to open and close a diaphragm or bellows-type structure. The acoustic panel is fronted by a micro-perforated face sheet of steel that has both sound diffusion and absorption characteristics. The opening or closing of the diaphragm changes the distance between the diaphragm and the micro-perforated face sheet, which changes the sound diffusion/absorption characteristics of the panel. The acoustic panel of embodiments of the present invention has its maximum sound absorption quality when the diaphragm is completely closed. Conversely, the acoustic panel would have its maximum sound diffusion quality when the diaphragm is fully open, as it provides a hard curved surface to diffuse sound waves.

In one representative embodiment the micro-perforated face sheet is steel, which provides a durable surface and maintains the shape and size of the micro-perforated holes. The face sheet can also be constructed of plastic or other durable material. For both aesthetics and sound absorption, the face sheet may be covered with fabric. Numerous fabrics can be used to modify both acoustic and aesthetic properties of the panel. The face material can be made of more durable and stable materials to withstand impact and denting that is expected in school and performing arts environments.

The micro-perforated panel is curved to provide proper diffusion. The panel uses the air space behind the face panel for absorption and the preferred embodiment has been increased to a 12 inch depth, and to gain more absorption. In addition, the overall square footage of the panel is increased from the 18 square feet of conventional panels, to 32 square feet, to provide the necessary absorption.

In another representative embodiment, the diaphragm is opened and closed via a rotating actuator that runs the vertical length of the acoustic panel. The rotating actuator could also run transversely across the width of the acoustic panel or more than one rotating actuator could be used in a single acoustic panel. Further, the rotating actuator does not have to run the entire length of the acoustic panel; it merely needs to function to open and close the diaphragm. The actuator can be made of metal, plastic, or any durable material with enough stiffness to open and close the diaphragm through numerous cycles.

In yet another embodiment, the diaphragm or bellows-type structure is comprised of two plastic sheets that are hinged on their sides to hold them together with the actuator lying between them.

In another representative embodiment, the rotating actuator is operated by a lever that is accessible on the exterior of the fully-assembled acoustic panel. The lever may also include a handle to assist in moving the lever to rotate the actuator. The handle may be provided with an indicator position that is labeled ABSORPTION or DIFFUSION.

The tunable acoustic panel of the present invention is designed to acoustically impact the range of frequencies from 125 Hz to 4,000 Hz. For a typically-sized rehearsal space, the amount of variability in changing the reverberation time ranges from 0.5 to 0.8 seconds. An embodiment of the present invention is an acoustic panel that is 48 inches by 48 inches and can be stacked to create a 48 inch by 96 inch acoustic panel that can be operated by a single lever. Using a stackable configuration makes installation of the tunable acoustic panels easier and safer.

In yet another representative embodiment of the present invention, the acoustic panel is shipped in a box with the panels of the diaphragm pre-installed into the tray of the panel with other components nested in molded cavities of the tray. Side-panel extrusions are attached at each end to top and bottom frame extrusions. The frame drops into the tray and snaps into place without fasteners. The lever is attached to the actuator and top and bottom finish panels are attached from the inside of the panel to cover the frame extrusion. Trim plates can be added for aesthetics and an actuator handle can be attached to the actuator lever. Mounting brackets are installed with appropriate spacing on the wall or other surface that will house the panel. The panel is then attached to the brackets to hold the panel in place. The micro-perforated panel is then installed on the front of the unit between the side-panel extrusions. Fabric is then installed to cover the micro-perforated panel and side-panel extrusions to complete the assembly and installation of the acoustic panel.

In another representative embodiment, multiple tunable acoustic panels as described herein are used in combination with panels that act only as acoustic diffusers or acoustic absorbers (i.e., panels that do not include an internal diaphragm or bellows-type structure) to provide a range of acoustic environments for a room that can be altered by simply adjusting the tunable panels to each diffuse or absorb acoustics. Currently available ceiling diffuser panels may be used in conjunction with the tunable and fixed acoustic wall panels to provide desired ceiling diffusion for the room.

A further embodiment of the invention is a method of making a room acoustically tunable by using a combination of tunable acoustic panels, panels that act only as acoustic diffusers or acoustic absorbers, and ceiling acoustic panels. The method includes determining the acoustic requirements of a room and modeling the acoustics of the room. The method further includes obtaining information from the owner of the room via a questionnaire. The questionnaire is designed to obtain not only the physical description of the room (dimensions and materials of construction), but the primary and secondary uses of the room (orchestra, band, choral, theater). The questionnaire used in this method also seeks use information such as the number of students that may use the room at a given time, the finishes of the room, they types of furniture in the room (storage cabinets, risers, staging). The information collected is used to acoustically model the room and determine the appropriate number of tunable acoustic and fixed acoustic panels as well as spacing requirements to optimize the acoustics for the various uses.

The above summary of the various representative embodiments of the invention is not intended to describe each illustrated embodiment or every implementation of the invention. Rather, the embodiments are chosen and described so that others skilled in the art can appreciate and understand the principles and practices of the invention.

ADVANTAGES OF THE INVENTION

- Innovative solution for treatment of music rehearsal spaces that allows the owner to easily change the reverberation time of the room without adding or removing fixed panels.
- Provides the ability to change the reverberation time in a room up to 0.8 seconds.
- Allows rehearsal rooms to be shared by different instrumental and choral groups.
- Allows an architect to design one rehearsal room for instrumental and choral usage, which saves thousands in building costs compared to designing separate rooms.
- System provides flexible rehearsal space and facilitates the resolution of scheduling conflicts for ensembles.
- System provides acoustical treatment with a more high-tech, contemporary, and aesthetically pleasing look that is more suitable for recital halls, small auditoriums, and cafetoriums.

DETAILED DESCRIPTION OF THE DRAWINGS

Figure 1:
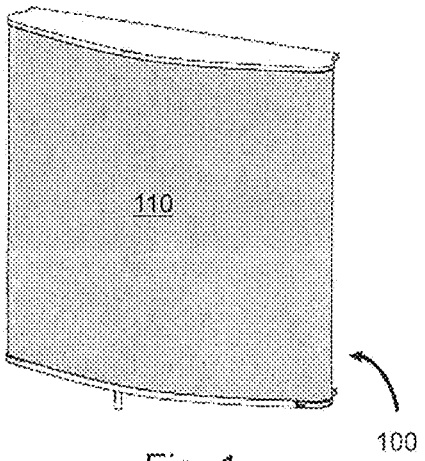
FIG. 1 is a front perspective view of a tunable acoustic panel according to an embodiment of the invention.

A tunable acoustic panel according to an embodiment is depicted generally in FIG. 1 with reference numeral 100. FIG.

Figure 2:
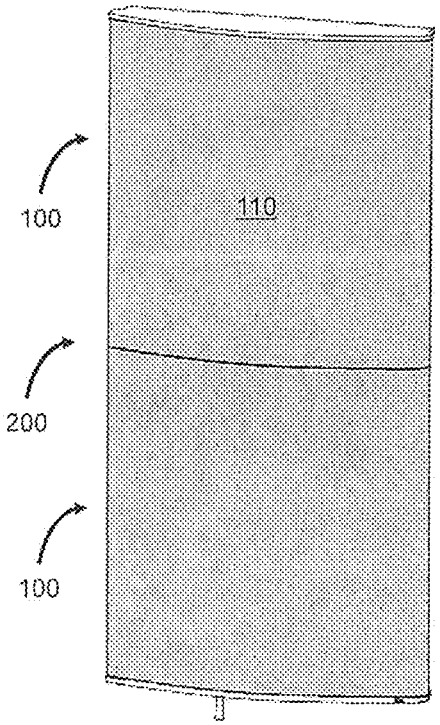
FIG. 2 is a front perspective view of a two stacked tunable acoustic panels according to an embodiment of the invention.

2 presents an embodiment of the tunable acoustic panel of the present invention in which two tunable panels 100 are stacked 200. The embodiments presented in FIGS. 1 and 2 include a fabric cover 110 that provides for both aesthetics and additional sound absorption. Fabric cover 110 can be of any material and design known in the art for purposes of modifying the acoustic and aesthetic properties of the panel 100.

Figure 4:
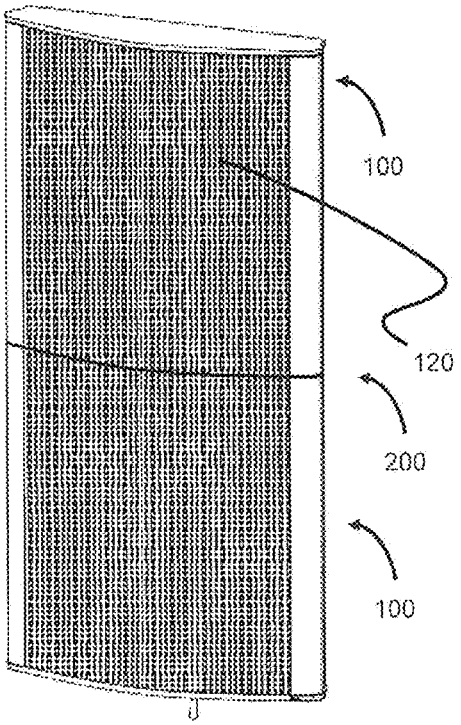
FIG. 4 is a front perspective view of a two stacked tunable acoustic panels according to an embodiment of the invention.
Figure 3:
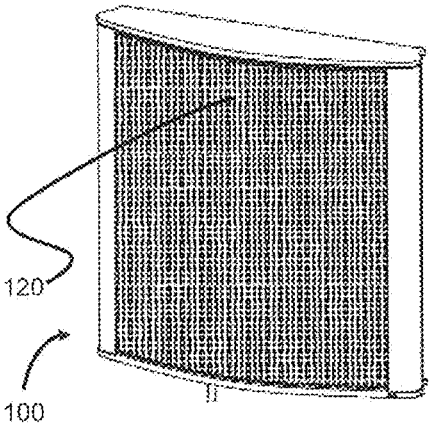
FIG. 3 is a front perspective view of a tunable acoustic panel according to an embodiment of the invention.
Figure 5:
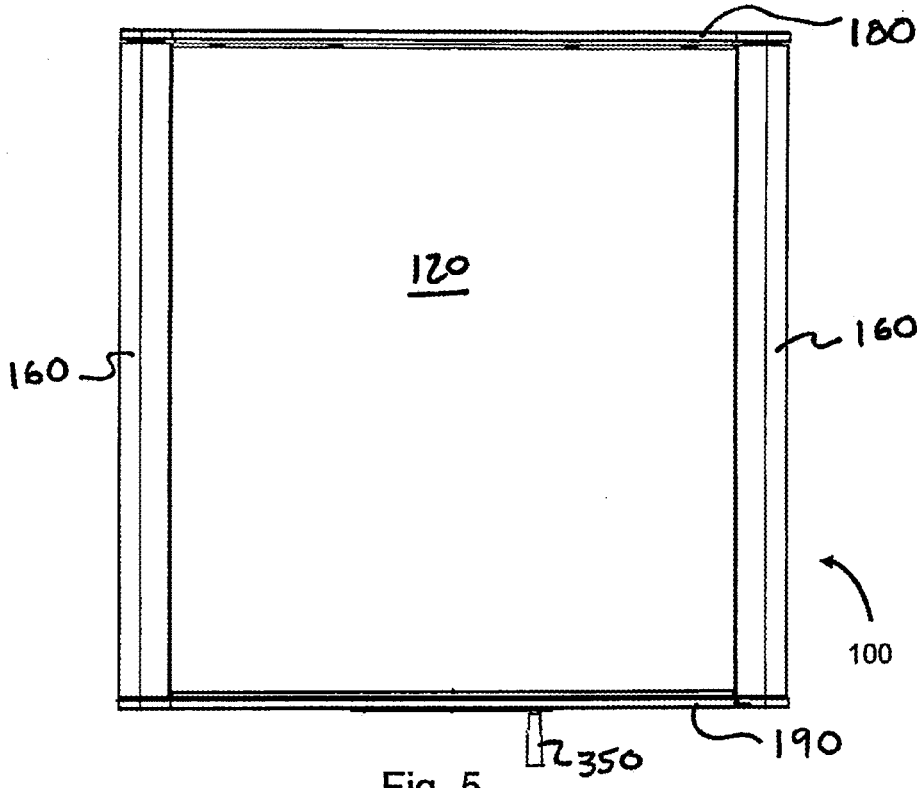
FIG. 5 is a front elevation view of a tunable acoustic panel according to an embodiment of the invention.
Figure 6:
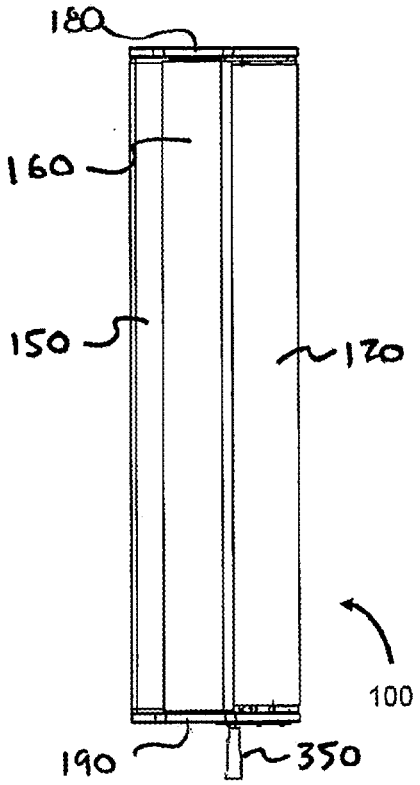
FIG. 6 is a left side elevation view of a tunable acoustic panel according to an embodiment of the invention.
Figure 7:
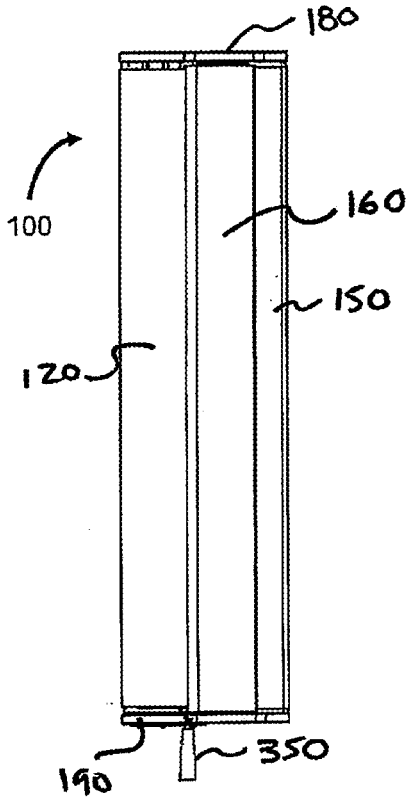
FIG. 7 is a right side elevation view of a tunable acoustic panel according to an embodiment of the invention.
Figure 8:
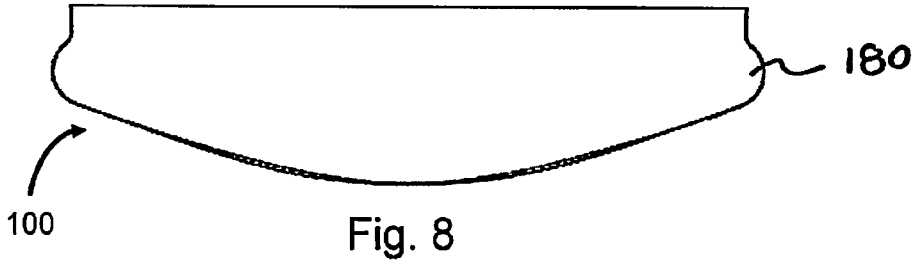
FIG. 8 is a top view of a tunable acoustic panel according to an embodiment of the invention.
Figure 9:
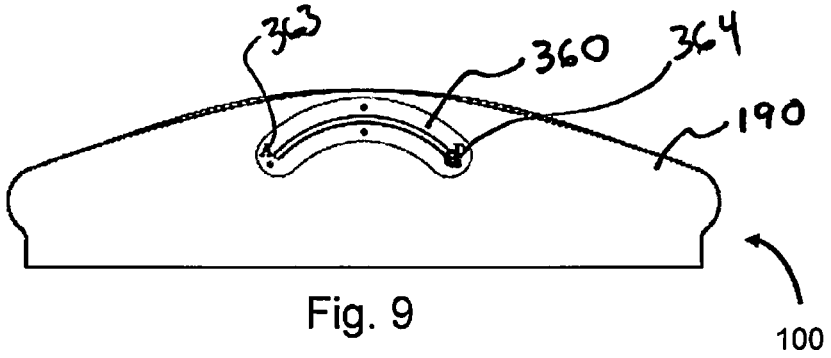
FIG. 9 is bottom view of a tunable acoustic panel according to an embodiment of the invention.
Figure 10:
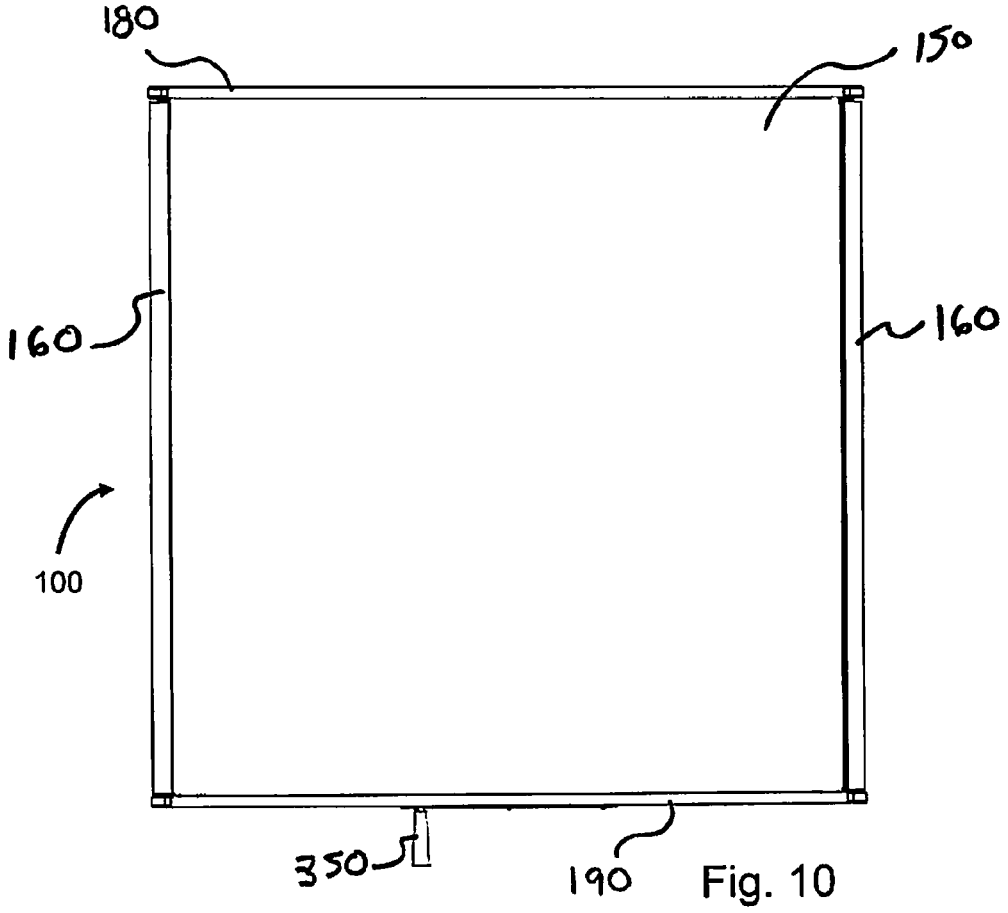
FIG. 10 is a rear elevation view of a tunable acoustic panel according to an embodiment of the invention.

Referring to FIG. 3, the tunable acoustic panel 100 is shown without a fabric cover 110. FIG. 4 presents the stacked arrangement of the tunable acoustic panels 100 of FIG. 2 without a fabric cover 110. The absence of fabric cover 110 from FIGS. 3 and 4 allow the acoustic sheets 130 of the tunable acoustic panel 100 to be visible. The acoustic sheet 130 can be made of any material that provides a durable surface that holds its shape and size, such as steel, aluminum, plastic, or even wood. Further, the acoustic sheet 130 can be modified so as to allow varying acoustic properties or durability. In the embodiment depicted in FIGS. 3 and 4, the acoustic sheet 130 is constructed of micro-perforated aluminum.

FIGS. 5-10 present various elevations as well as top and bottom views of an embodiment of a tunable acoustic panel according to the invention without a fabric cover. The tunable acoustic panel 100 is comprised of a back panel 150, left and right side panels 160, a top finish cap 180, and a bottom finish cap 190. Handle 350 allows the acoustic properties of the tunable acoustic panel 100 to be modified from predominantly absorbing to predominantly diffusing. Function indicator 360 includes markings 363, 364 that allow a user to determine the relative acoustic setting of the tunable acoustic panel 100. In the preferred embodiment, top finish cap 180 and bottom finish cap 190 are aesthetic pieces constructed of laminated particleboard for durability with edge banding to allow for select wood grain finishes. The preferred embodiment of the present invention is a tunable acoustic panel 100 with finished exterior dimensions of 48 inches in height by 48 inches in width and 12 inches in depth. These dimensions allow for easier configuration in multi-function rehearsal rooms, recital halls, and cafetoriums.

Figure 11:
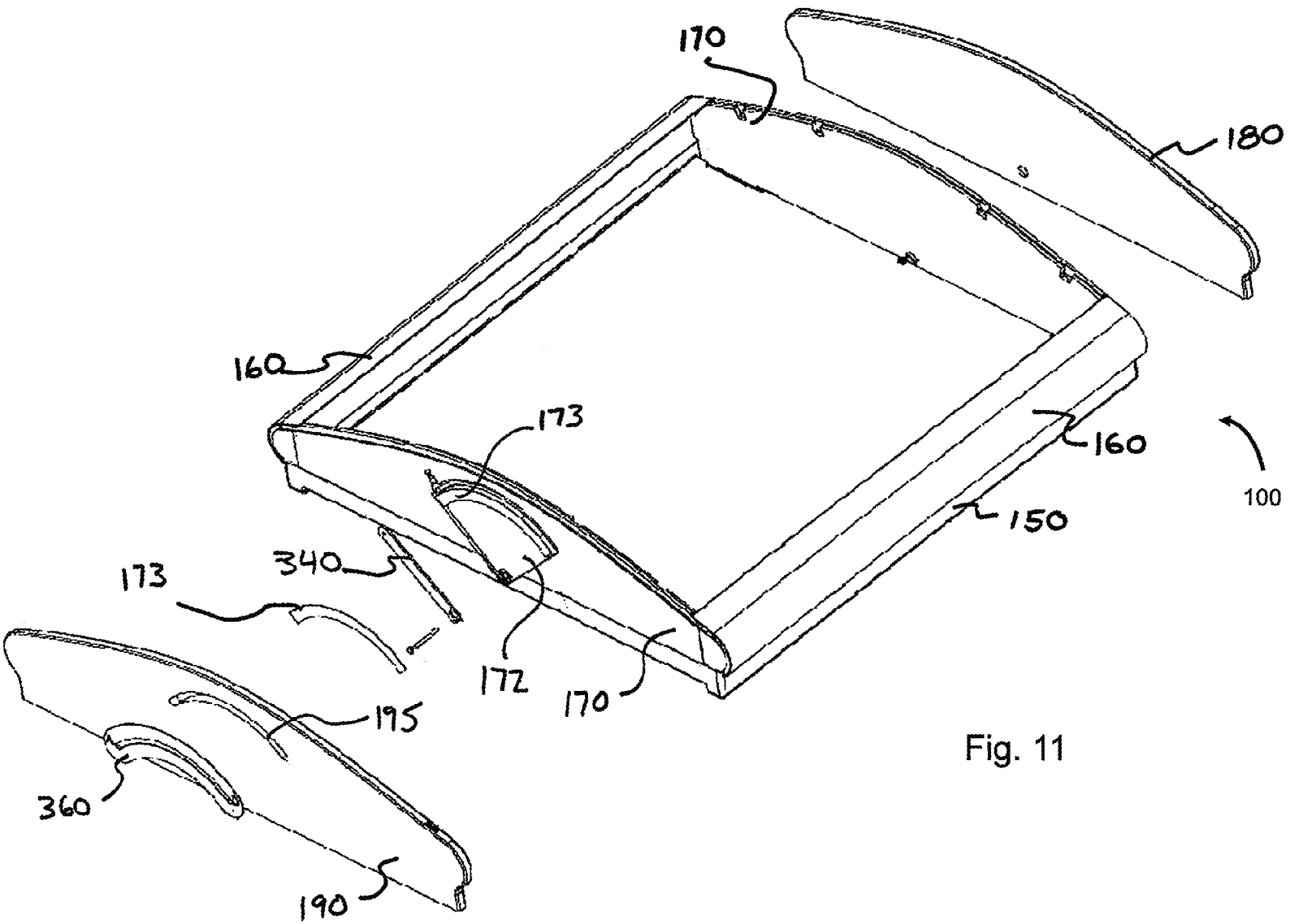
FIG. 11 is an exploded perspective view of a tunable acoustic panel according to an embodiment of the invention.
Figure 12:
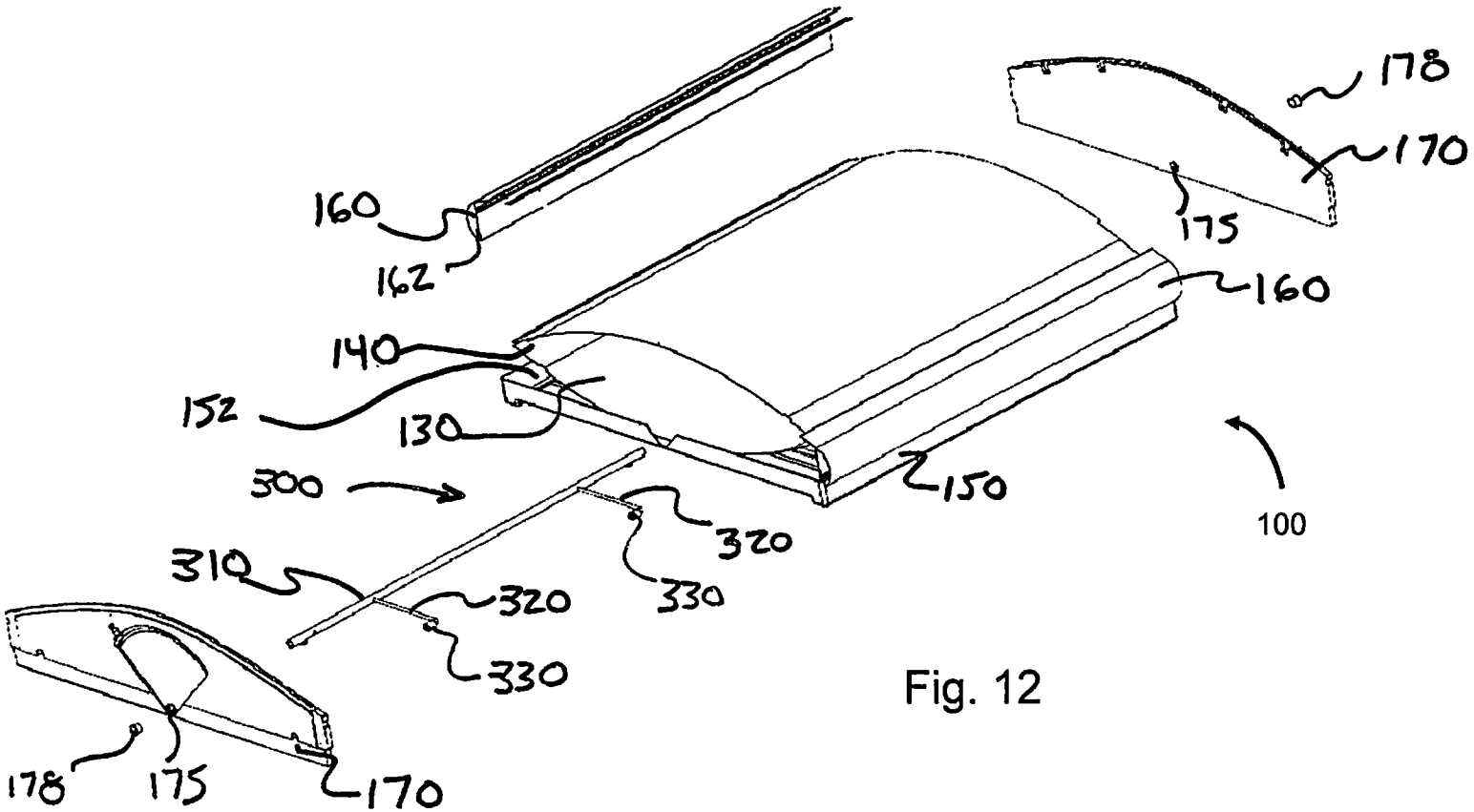
FIG. 12 is a partially exploded assembly view of a tunable acoustic panel according to an embodiment of the invention.

Referring to FIGS. 11 and 12, the back panel 150 is preferably aluminum due to its light weight. The side panels 160 of the preferred embodiment are constructed of durable aluminum extrusions to provide lightweight rigidity to the tunable acoustic panel. In the preferred embodiment, the side panels 160 are extruded with a slot 162 (FIG. 12) that runs the length of the panel 160 to accommodate the sidewalls 152 of back panel 150. This configuration allows for a clean finish and allows the fabric cover 110 to be installed without protrusions. Other embodiments contemplate using an adhesive, screws, or other methods known in the art to fasten the side panels 160 to the back panel 150. The bottom finish cap 190 includes handle slot 195 to allow the handle 350 to connect to the handle lever 340 and to provide a guide for the movement of the handle 350. The bottom end cap 170 includes a handle lever guide 172 to control the movement of the handle lever 340 when the handle 350 in rotated between diffuser and absorber positions and to accommodate the handle lever 340 between bottom end cap 170 and bottom finish cap 190. Wear strips 173 may be provided along the handle lever guide 172 and handle slot 195 to allow for smooth movement of the handle 350 and to protect the handle lever guide and handle slot 195 from wear caused by friction of the handle lever 340.

In the preferred embodiment, end panels 170 are affixed to the back panel 150 and side panels 160 by screws (not shown) to add rigidity to the tunable acoustic panel 100 and to allow for mounting of an actuator assembly 300. End panels 170 may also be affixed to the back panel 150 and side panels 160 by adhesives, bolts, or other fastening mechanisms known in the art. End panels 170 include actuator rod mounts 175 to accept the ends of the actuator rod 310 of the actuator assembly 300. In the preferred embodiment actuator rod mounts 175 are an orifice that accepts a bearing 178 of appropriate size to receive the actuator rod 310.

Figure 19:
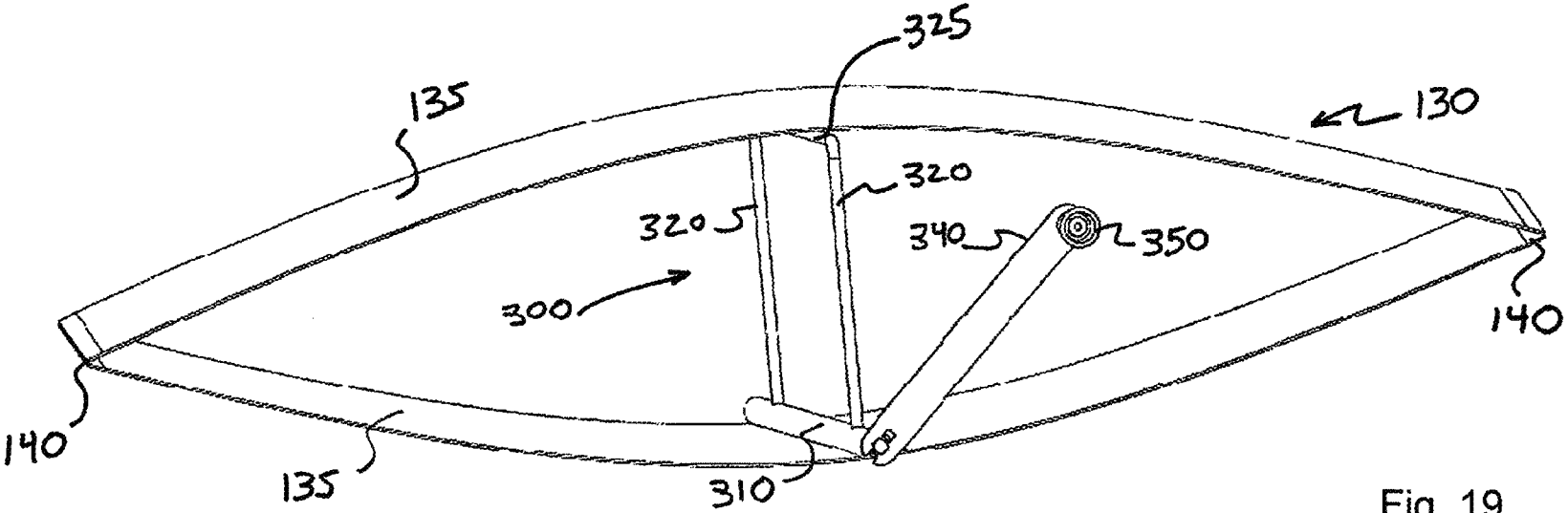
FIG. 19 is an isolated perspective view of an actuator assembly of a tunable acoustic panel in diffuser mode according to an embodiment of the invention.

Referring to FIGS. 12 and 19, the actuator assembly 300 comprises an actuator rod 310, actuator arms 320, actuator bearings 330 (FIG. 12), a handle lever 340, and a handle 350. Alternatively, the actuator assembly 300 could comprise an actuator link (FIG. 19) that connects the actuator arms 320 distal to the actuator rod 310. The actuator rod 310, actuator arms 320, and handle lever 340 are preferable made of steel for rigidity, but may be made of any material sufficient to activate the expandable acoustic diaphragm 130. Actuator bearings 330 allow for the actuator assembly 300 to move smoothly along the interior of the expandable acoustic diaphragm 130 when altering the acoustic property of the tunable acoustic panel 100. The number of actuator arms 320 is dependent on the flexibility and size of the expandable acoustic diaphragm 130. The preferred embodiment includes two actuator arms 320 to minimize the overall weight of the tunable acoustic panel 100 while providing adequate ability to modify the expandable acoustic diaphragm 130.

In one embodiment, the expandable acoustic diaphragm 130 is constructed of two actuator panels 135 joined together along most of the length of their side edges by hinges 140 (FIG. 12). In the preferred embodiment the actuator panels 135 are constructed of sheet aluminum, but can be made of other materials that are stiff enough to retain shape and provide an acoustically reflective surface, such as plastic. Hinges 140 can be made of any material suitable for keeping the edges of actuator panels 135 together through numerous expansions and contractions of the expandable acoustic diaphragm 130. The side panels 160 and acoustic sheet 120 keep the expandable acoustic diaphragm 130 inside the tunable acoustic panel 100 during expansion. The expandable acoustic diaphragm 130 could also be made of a single sheet of material that is scored in the middle to allow the one actuator panel 135 to be folded over and provide for the expansion of the diaphragm 130.

Figure 13:
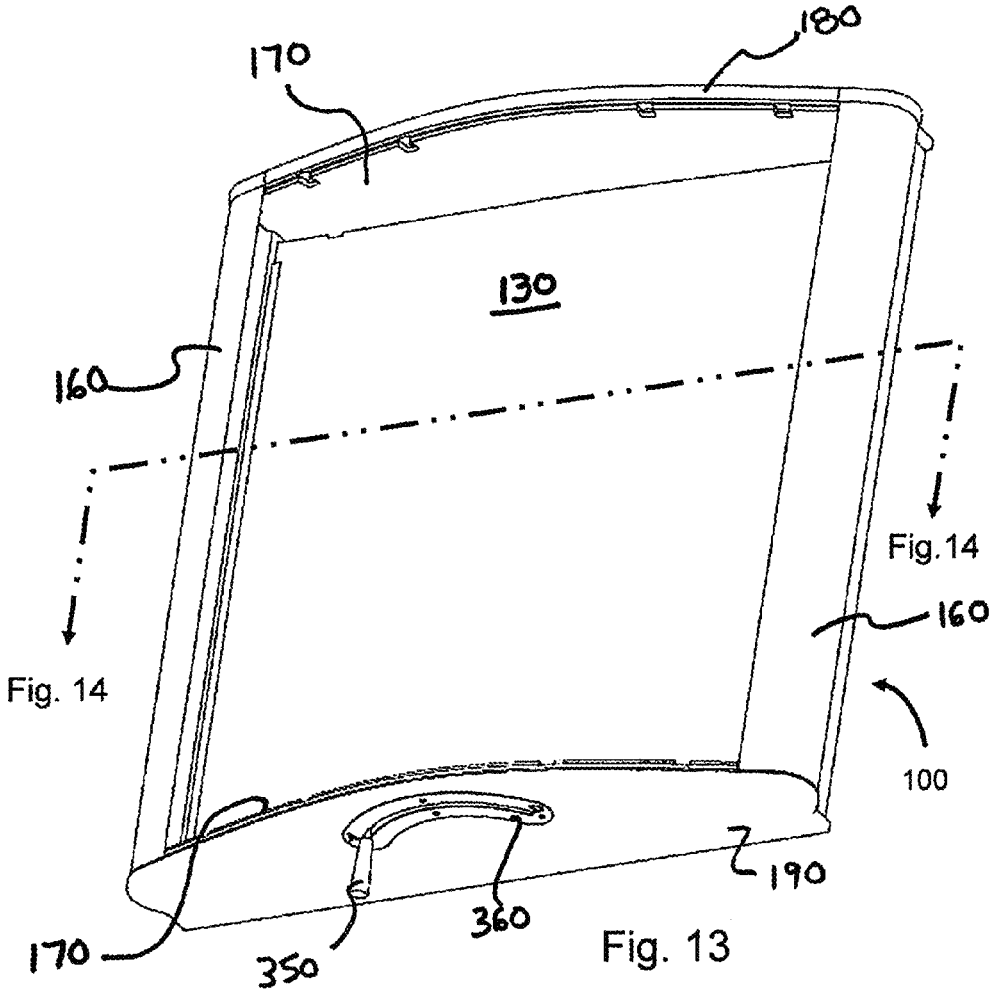
FIG. 13 is an interior view of a tunable acoustic panel in absorber mode according to an embodiment of the invention.
Figure 14:
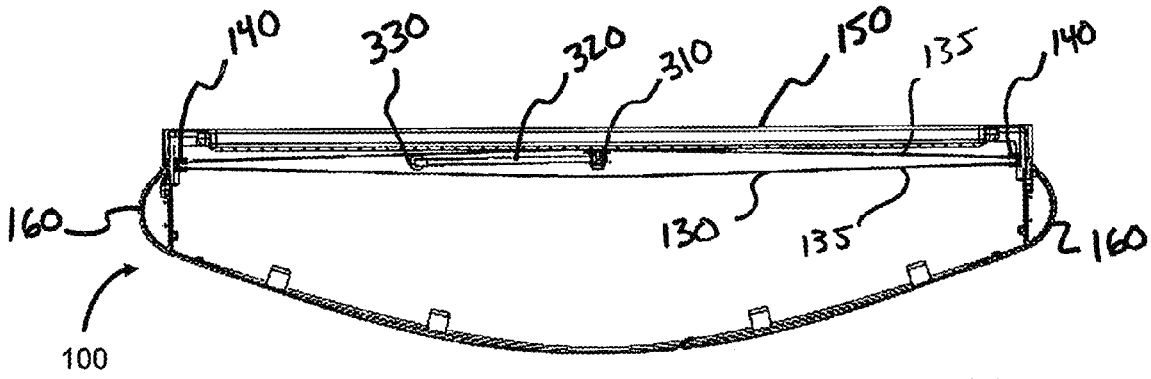
FIG. 14 is a section view of a tunable acoustic panel in absorber mode according to the embodiment illustrated in FIG. 13.
Figure 15:
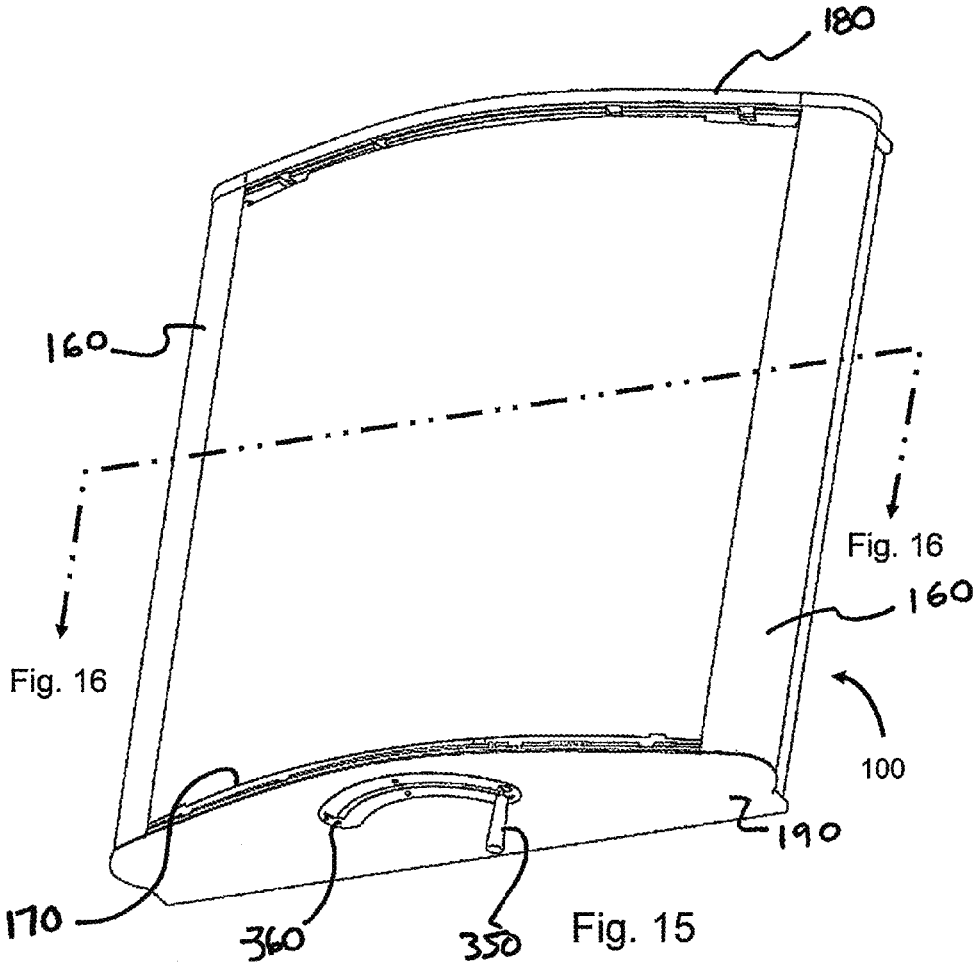
FIG. 15 is an interior view of a tunable acoustic panel in diffuser mode according to an embodiment of the invention.
Figure 16:
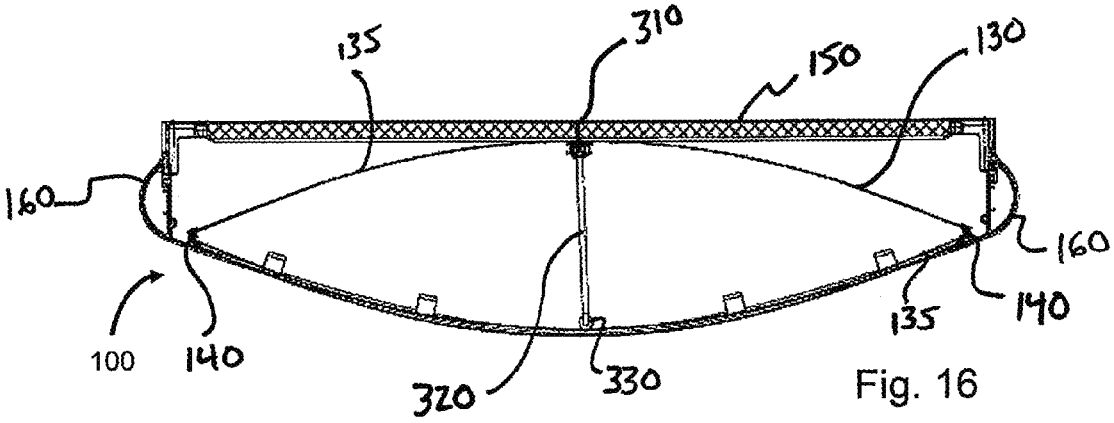
FIG. 16 is a section view of a tunable acoustic panel in diffuser mode according to the embodiment illustrated in FIG. 15.
Figure 17:
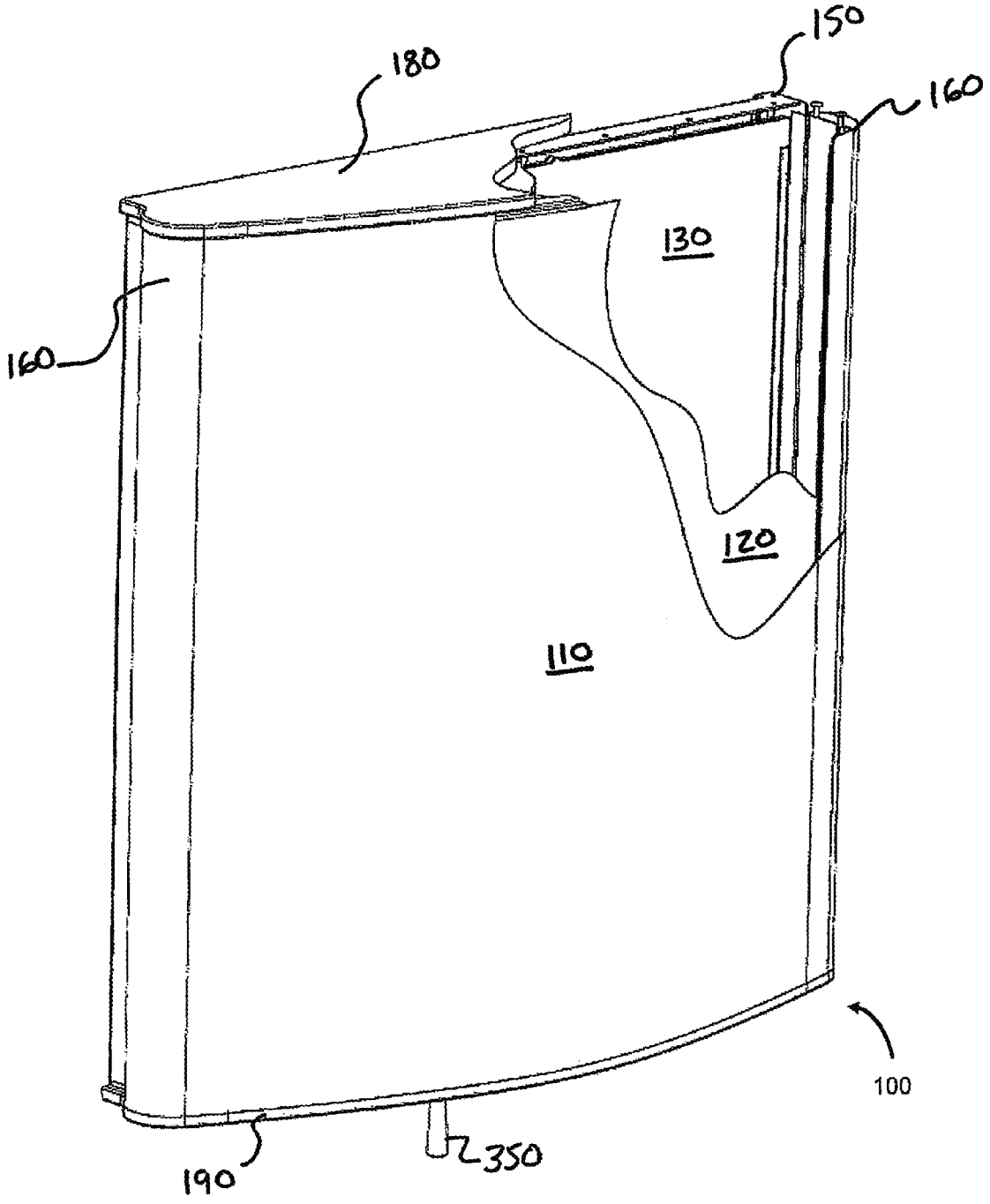
FIG. 17 is a cutaway front perspective view of a tunable acoustic panel in absorber mode according to an embodiment of the invention.
Figure 18:
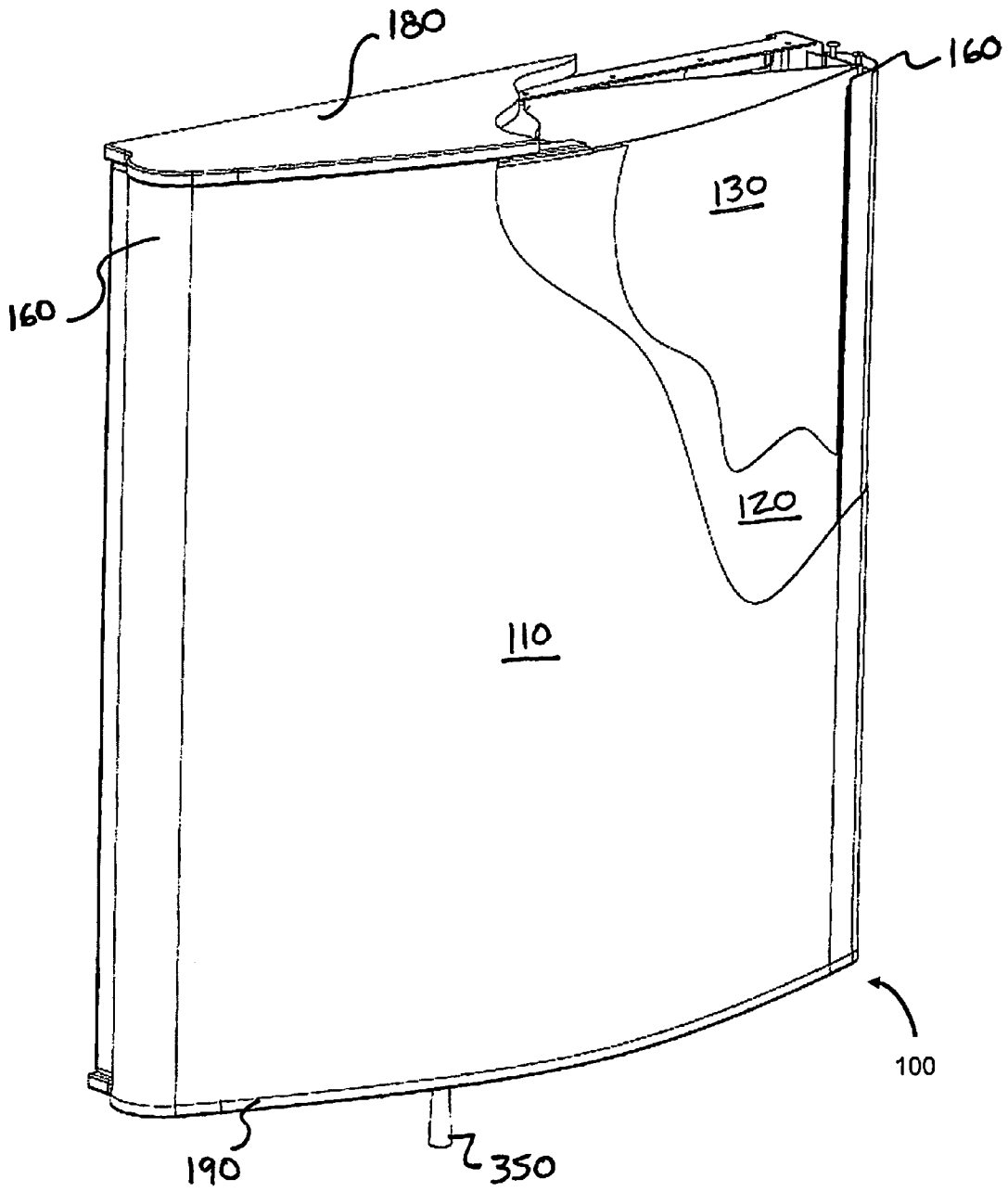
FIG. 18 is a cutaway front perspective view of a tunable acoustic panel in diffuser mode according to an embodiment of the invention.

FIGS. 13-18 present the tunable acoustic panel 100 in maximum absorption mode (FIGS. 13-14 and 17) and maximum diffusion mode (15-16 and 18). As can be seen in FIGS. 13-14 and 17, the tunable acoustic panel 100 is in maximum absorption mode when the actuator panels 135 and drawn together with the actuator mechanism flat against the back actuator panel 135. This configuration provides the largest spacing between the front actuator panel 135 and the acoustic sheet 120. FIGS. 15-16 and 18 present the acoustic panel 100 in maximum diffuser mode when the actuator arm 320 is fully extended and the front actuator panel 135 is pressed against the acoustic sheet 120.

The embodiments above are intended to be illustrative and not limiting. Additional embodiments are within the claims. In addition, although embodiments of the invention have been described with reference to particular embodiments, those skilled in the art will recognize that changes can be made in form and detail without departing from the spirit and scope of the invention.

We claim:

1. A tunable acoustic panel comprising:

an acoustic sheet;

an acoustic diaphragm;

an actuator assembly positioned within the acoustic diaphragm; and a handle mechanically coupled to the actuator assembly and accessible on the exterior of the tunable acoustic panel;

wherein movement of the handle causes the acoustic diaphragm to expand or contract.

2. The tunable acoustic panel of claim 1, wherein the acoustic sheet is micro-perforated.

3. The tunable acoustic panel of claim 2 further comprising a top end cap and a bottom end cap, wherein the actuator assembly is mechanically coupled to the top end cap and the bottom end cap.

4. The tunable acoustic panel of claim 3, wherein the actuator assembly comprises an actuator rod and an actuator arm.

5. The tunable acoustic panel of claim 4, wherein the actuator assembly further comprises an actuator bearing.

6. The tunable acoustic panel of claim 2, wherein the acoustic sheet is aluminum.

7. The tunable acoustic panel of claim 6, wherein the acoustic diaphragm comprises:

an aluminum sheet; and a hinge.

8. The tunable acoustic panel of claim 7, wherein the actuator assembly comprises an actuator rod and an actuator arm.

9. The tunable acoustic panel of claim 8 further comprising an actuator link.

10. The tunable acoustic panel of claim 9 further comprising a fabric cover.

11. A method for altering the acoustic character of a room comprising:

providing a tunable acoustic panel comprising:

an acoustic sheet;

an acoustic diaphragm;

an actuator assembly positioned within the acoustic diaphragm; and a handle mechanically coupled to the actuator assembly and accessible on the exterior of the tunable acoustic panel wherein movement of the handle causes the acoustic diaphragm to expand or contract;

providing an acoustic panel with fixed acoustic properties; and moving the handle.

12. An acoustic panel comprising:

an acoustic sheet;

an actuator panel;

an actuator assembly positioned within the actuator panel; and a handle mechanically coupled to the actuator assembly and located on the exterior of the tunable acoustic panel;

wherein movement of the handle changes the distance between the actuator panel and the acoustic sheet.

13. The acoustic panel of claim 12 wherein the acoustic sheet is micro-perforated.

14. The acoustic panel of claim 13 further comprising a top end cap and a bottom end cap, wherein the actuator assembly is mechanically coupled to the top end cap and the bottom end cap.

15. The acoustic panel of claim 14 wherein the actuator assembly comprises:

an actuator rod;

an actuator arm; and an actuator bearing.

16. The acoustic panel of claim 15 further comprising a fabric cover.

17. A tunable acoustic panel for mounting on a vertical surface comprising:

a face sheet;

an actuator panel;

an actuator assembly positioned within the actuator panel; and means for manually altering the distance between the actuator panel and the face sheet while the tunable acoustic panel remains mounted on the vertical surface.

18. The tunable acoustic panel of claim 17 wherein the face sheet is micro-perforated.

19. The tunable acoustic panel of claim 18 wherein the face sheet is aluminum.

20. The tunable acoustic panel of claim 19 further comprising a fabric cover.

* * * * *